US005465198A

United States Patent [19]

Kellogg

[11] Patent Number: 5,465,198

[45] Date of Patent: Nov. 7, 1995

[54] COMBINATION CLOCK RADIO, NIGHT LIGHT AND POWER RECEPTACLE

[76] Inventor: Diane L. Kellogg, 10372 Southerland Dr., Boise, Id. 83709

[21] Appl. No.: 261,812

[22] Filed: Jun. 17, 1994

[51] Int. Cl.[6] ..... F21V 33/00

[52] U.S. Cl. ..... 362/253; 362/276; 362/802; 455/344

[58] Field of Search ..... 362/253, 276, 362/226, 95, 234, 802, 801, 86; 455/344; 340/539

[56] References Cited

U.S. PATENT DOCUMENTS

| | | | |
|---|---|---|---|
| 3,061,716 | 10/1962 | Benander | 362/95 |
| 3,243,587 | 3/1966 | Relich | 362/226 |
| 3,382,355 | 5/1968 | Prifogle | 362/95 X |
| 4,285,028 | 8/1981 | Sundin et al. | 362/35 |
| 4,584,633 | 4/1986 | Comfort | 362/253 |
| 4,816,973 | 3/1989 | Atalla et al. | 362/226 |
| 4,949,077 | 8/1990 | Mbuthia | 340/628 |
| 4,977,515 | 12/1990 | Rudden et al. | 364/492 |
| 5,014,168 | 5/1991 | Kelly | 362/86 |
| 5,045,833 | 9/1991 | Smith | 340/332 |
| 5,055,986 | 10/1991 | Johnson | 362/253 |
| 5,309,145 | 5/1994 | Branch et al. | 362/802 |

*Primary Examiner*—Ira S. Lazarus
*Assistant Examiner*—Thomas M. Sember
*Attorney, Agent, or Firm*—Frank J. Dykas

[57] ABSTRACT

A combination appliance including the features of a radio, a clock and a light fixture and an electrical receptacle operated by alternating current. The combination appliance would be constructed such that a common three prong alternating current electrical connector would extend from the back of the appliance powering a common electrical bus within the casing of the appliance, to which the various features, the radio, clock and light fixture, which may or may not be switched, would be operatively connected. In addition, the appliance would provide a receptacle, operatively connected to the electrical bus, to accept a common two or three prong electrical connector to provide power to other alternating current operated appliances. In addition, the appliance may provide with its circuitry a ground fault interrupter.

19 Claims, 6 Drawing Sheets

COMBINATION CLOCK RADIO, NIGHT LIGHT AND POWER RECEPTACLE

BACKGROUND OF THE INVENTION

1. Technical Field

The present invention relates generally to the field of electrical appliances and is more particularly directed to a combination appliance which includes a radio, clock, light, and an alternating current power receptacle.

2. Background

Typically, a bathroom may be designed so as to provide a single electrical outlet commonly having two receptacles for providing power to a multitude of appliances which may be used in the bathroom. These appliances may include electric razors, hair dryers, curling irons, radios, clocks, night lights, and any number of other electrically operated appliances or conveniences which the homeowner may desire to have access to while using the bathroom.

Obvious to say there typically is a premium or shortage of electrical outlets or receptacles in a bathroom, due to the number of appliances which may be used therein.

A number of devices have been designed which combine several common appliances into one single housing. Although they are not specified necessarily for use in the bathroom, they may be adapted for that use.

Various appliances are found in the prior art which combine elements of several appliances or other useful features. For example, Johnson, U.S. Pat. No. 5,055,986, combines a light, a radio, and a clock for operation with batteries or by current supplied by conventional alternating current. The Johnson apparatus is operated either by conventional alternating current which is converted to direct current by a transformer, or by direct current supplied by rechargeable batteries.

Kelly, U.S. Pat. No. 5,014,168, combines the features of a radio and light fixture which is mountable on a wall or other surface. The primary objective of Kelly was to locate a radio for use in a bathroom or other room which contains a bathtub or shower very near to a light fixture from which is generated a substantial amount of heat in order to prevent accumulation of moisture upon the radio and its components.

Mbuthia, U.S. Pat. No. 4,949,077, describes a personal security device which includes a combination of a smoke detector and smoke alarm system, a radio, a digital time clock, a compass, a high intensity lamp, and a retractable writing table. The Mbuthia apparatus is battery operated and is intended in part for use as a table or writing surface.

Atalla, U.S. Pat. No. 4,816,973, describes a socket mounted appliance which combines a light fixture and an air freshening device.

Comfort, U.S. Pat. No. 4,584,633, describes a combination night light and eyeglass holder. This fixture is wall mounted and powered by conventional alternating current.

One last combination appliance is defined by Sundin, U.S. Pat. No. 4,285,028, which describes a bedroom lamp with clock. Sundin defines or describes a lamp fixture which is operated by a clock which is integral to the lamp base.

None of the prior art describes an apparatus or appliance which allows the combination of a radio, clock, light fixture and an electrical receptacle such that there is no net loss in the number of receptacles available within the room in which the appliance is used.

Additionally, the prior art describes either battery powered devices or devices which if powered by conventional house current require a cord. One of the advantages of the preferred embodiment of my invention is that it is powered by conventional household current and therefore does not require batteries. Unlike the combination appliances described in the prior art, the preferred embodiment of my invention does not utilize a cord which extends from the power source to the appliance. Because the appliance mounts directly to the electrical outlet, it does not occupy counter space which is also typically at a premium in the bathroom. Finally, because the preferred embodiment of my invention mounts directly to the electrical outlet, should it fall, it becomes immediately de-energized, unlike the prior art devices powered by conventional house current which require a cord. With these devices, a risk of electrocution may occur where the appliance falls into a tub or sink without being de-energized.

What I propose is a combination appliance operated by alternating current. The combination appliance would be adapted such that a common three prong alternating current electrical connector would extend from the back of the appliance powering a common electrical bus within the casing of the appliance. To this electrical bus, the following appliances would be operatively connected within the casing: a radio, a clock and a light fixture, which may or may not be switched by a photocell. In addition, the appliance would provide a receptacle, operatively connected to the electrical bus, to accept a common two or three prong electrical connector to provide power to other alternating current operated appliances. In addition, the appliance may provide with its circuitry a ground fault interrupter.

It is an object of this invention, therefore, to provide a combination radio, clock, light appliance which further incorporates the feature of an electrical outlet, all of the aforementioned operatively connected to an electrical bus and housed within a common casing, such that there is no net loss in the number of receptacles available on the outlet in which the appliance is installed.

DISCLOSURE OF INVENTION

This and other objectives of the invention are provided in a combination radio, clock either digital or analog and light which may or may not be switched manually or by a photocell or motion sensor. All of the described features are preferably housed in a single casing. In addition, the casing provides at least one receptacle, such that there is no net loss in the number of receptacles available at any given electrical outlet. In addition, the appliance may provide a ground fault interrupter within its circuitry as a safety feature.

BEST MODE FOR CARRYING OUT INVENTION

Figure 1:
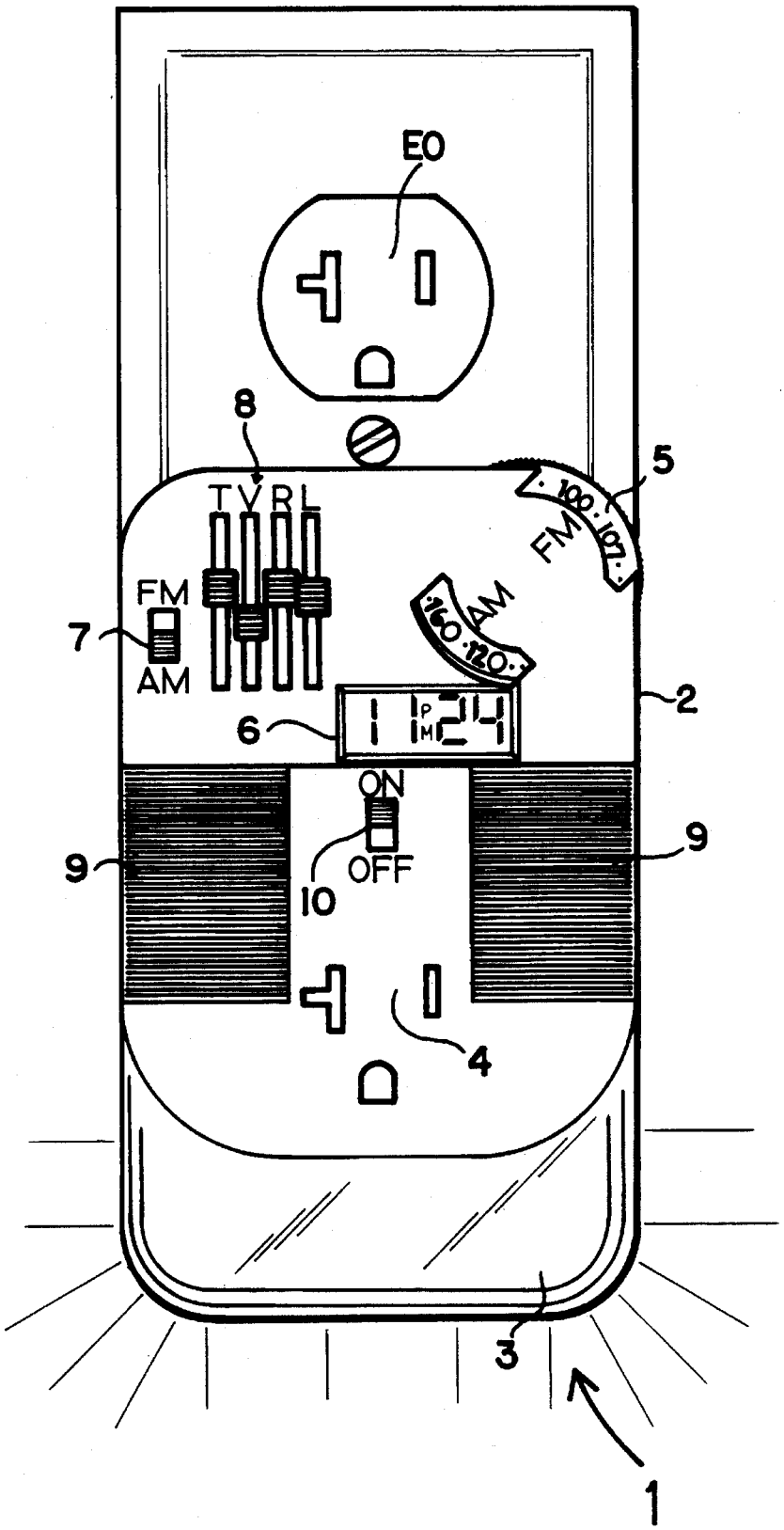
FIG. 1 is a front elevation view of a first preferred embodiment of the combination radio, clock, light, electrical receptacle appliance.
Figure 2:
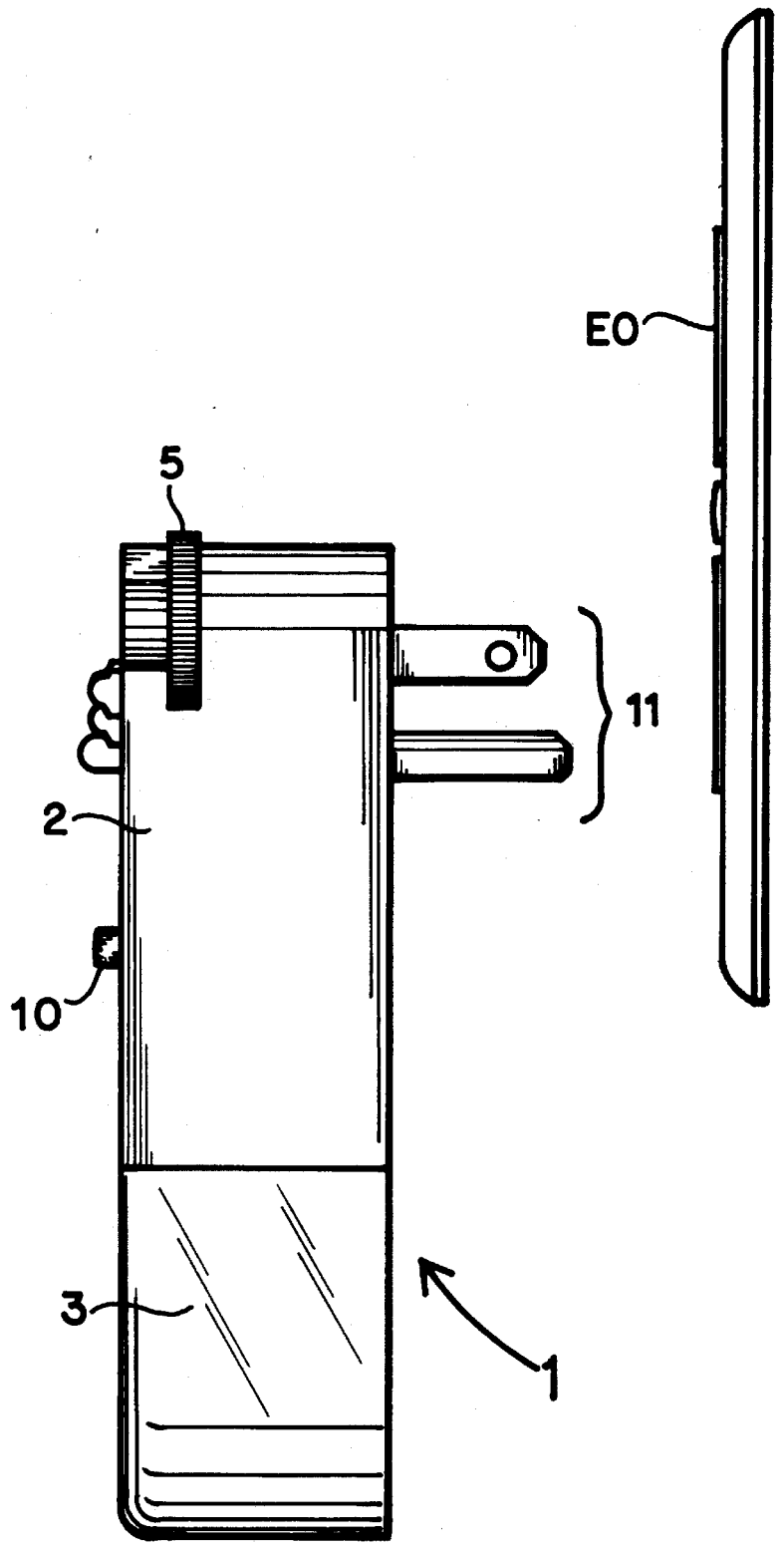
FIG. 2 is a side elevation view of a first preferred embodiment of the combination radio, clock, light, electrical receptacle appliance.

Referring initially to FIG. 1 a first alternative preferred embodiment of the combination radio, clock, light and electrical receptacle 1 is illustrated. In this alternative embodiment, casing 2 houses all of the features of the preferred embodiment. These features include: light 3; switch 10; electrical receptacle 4; radio tuner 5; clock 6; radio band selector 7; radio output controls 8; and speaker grill 9. Also housed within casing 2 is the circuitry necessary for operation of the described invention. FIG. 2 shows a side elevation of the first preferred embodiment of the described invention. Combination radio, clock, light and electrical receptacle 1 is adapted to provide a typical three prong electrical connector 11 for engaging a three hole receptacle EO commonly used for 120 volt household current.

Figure 3:
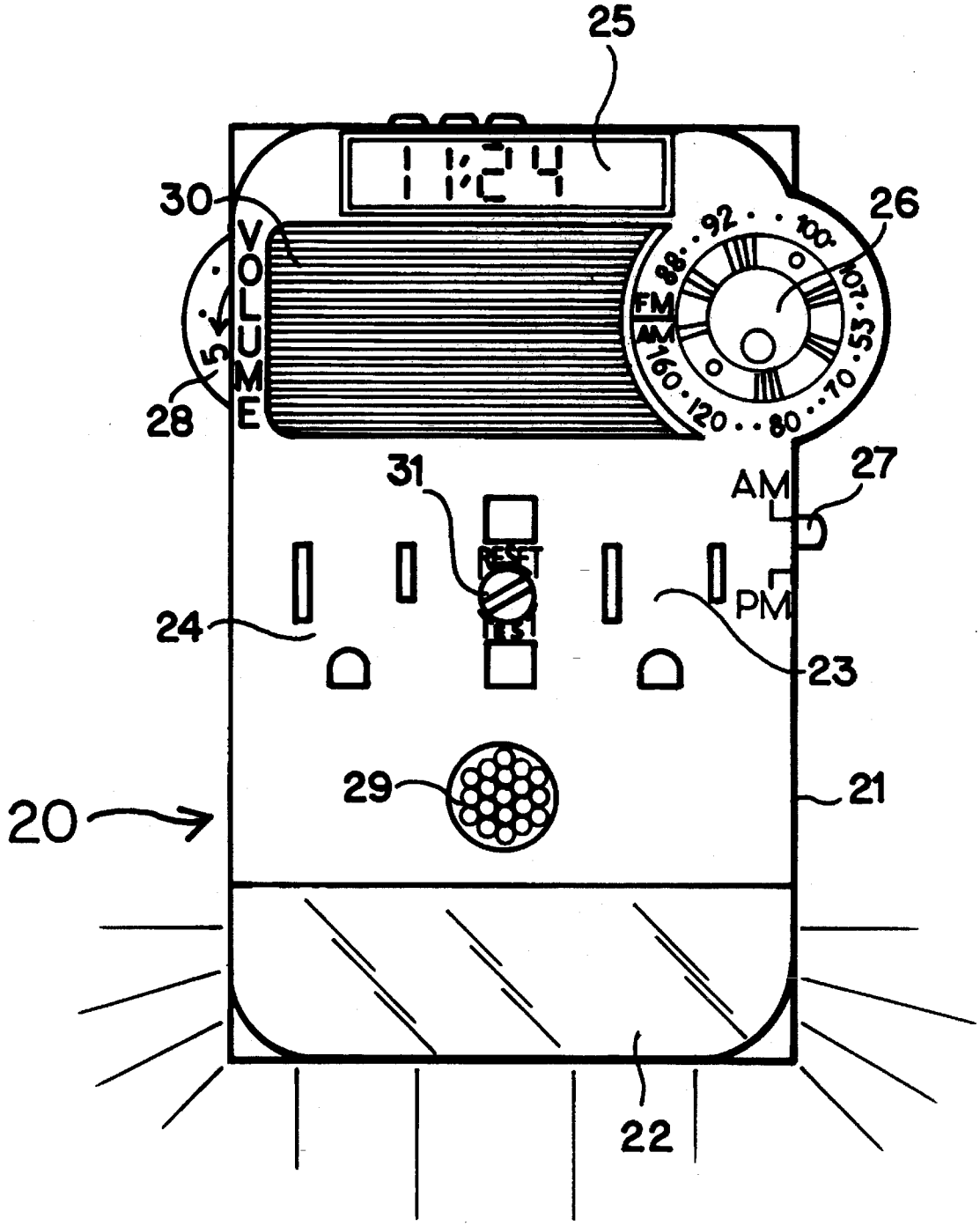
FIG. 3 is a front elevation view of a second preferred embodiment of the combination radio, clock, light, electrical receptacle appliance.

FIG. 3 shows a second preferred embodiment of the combination light, radio, clock and electrical receptacle 20, wherein the casing 21 houses the following features: light 22, receptacles 23 and 24; clock 25; radio tuner 26, radio band selector 27, radio signal output adjustment for volume 28; photocell 29, speaker housing 30 and ground fault interruption/reset 31.

Figure 4:
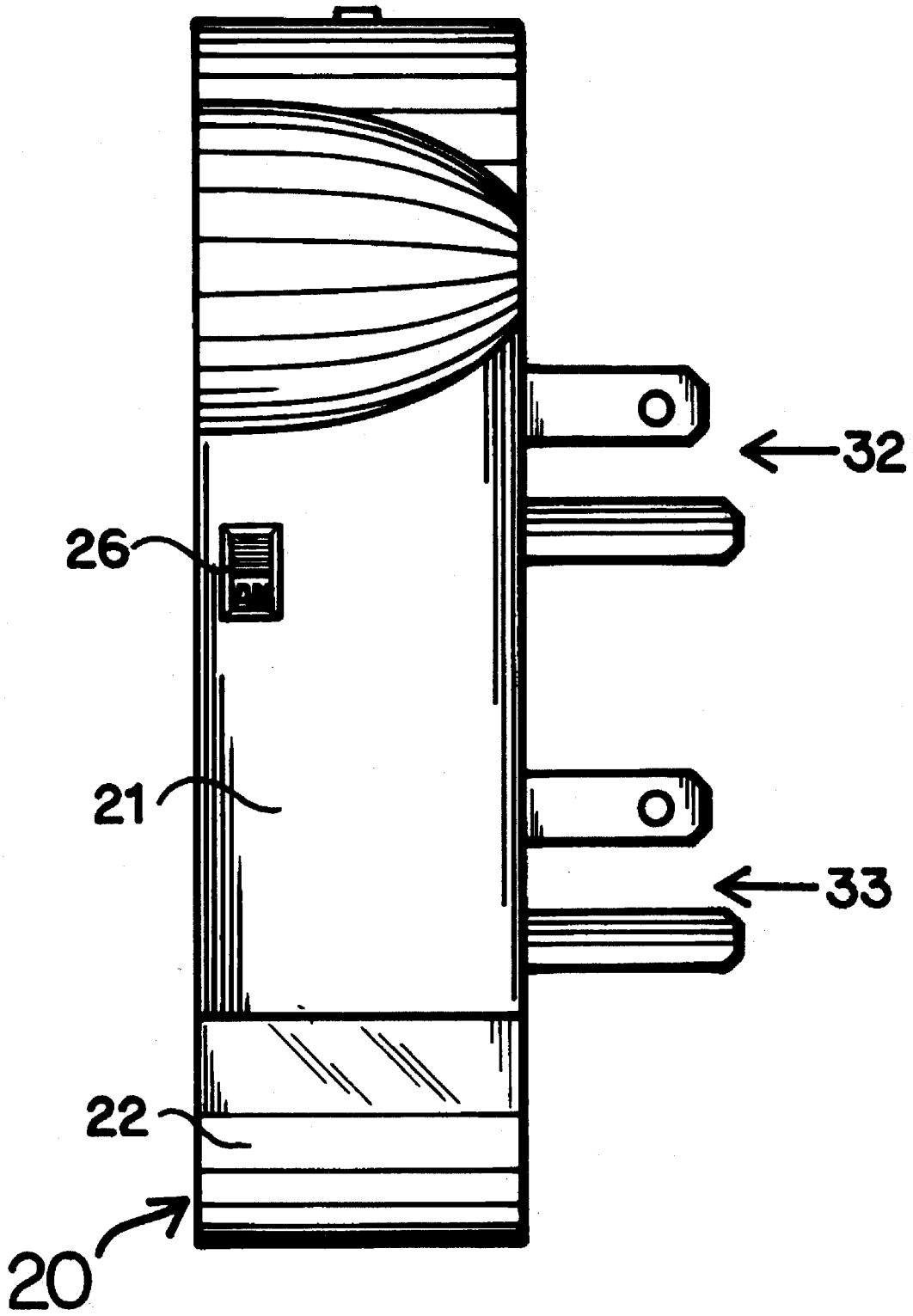
FIG. 4 is a side elevation view of a second preferred embodiment of the combination radio, clock, light, electrical receptacle appliance.

FIG. 4 shows a side view of a second preferred embodiment of the combination radio, clock, light and electrical receptacle 20, which shows three prong electrical connectors 32 and 33, for engaging three hole receptacles commonly used for 120 volt household current.

Figure 5:
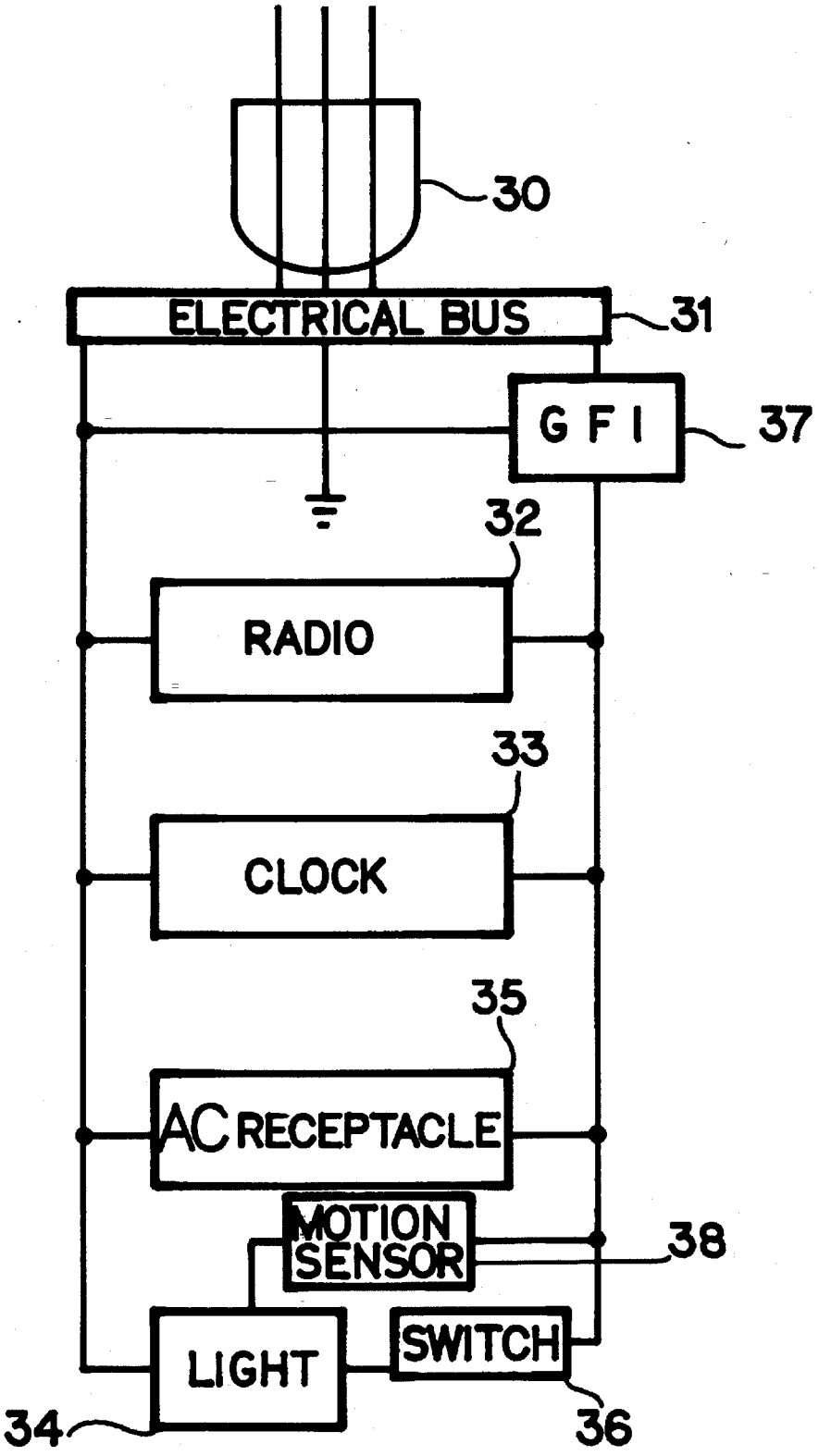
FIG. 5 is an electrical block diagram showing schematically the various components and connections within a third preferred embodiment of the combination radio, clock, light, electrical receptacle appliance.

Referring to FIG. 5, the various components and connections within a third preferred embodiment of the combination radio, clock, light, electrical receptacle appliance are depicted schematically by an electrical block diagram. Electrical connector 30 is operatively connected to electrical bus 31. FIG. 5 depicts schematically the connection of radio 32, clock 33, light 34 and electrical receptacle 35, operatively connected to electrical bus 31. Light 34 is energized alternatively by switch 36 or motion sensor 38. Also operatively connected to electrical bus 31 is ground fault interrupter 37.

Figure 6:
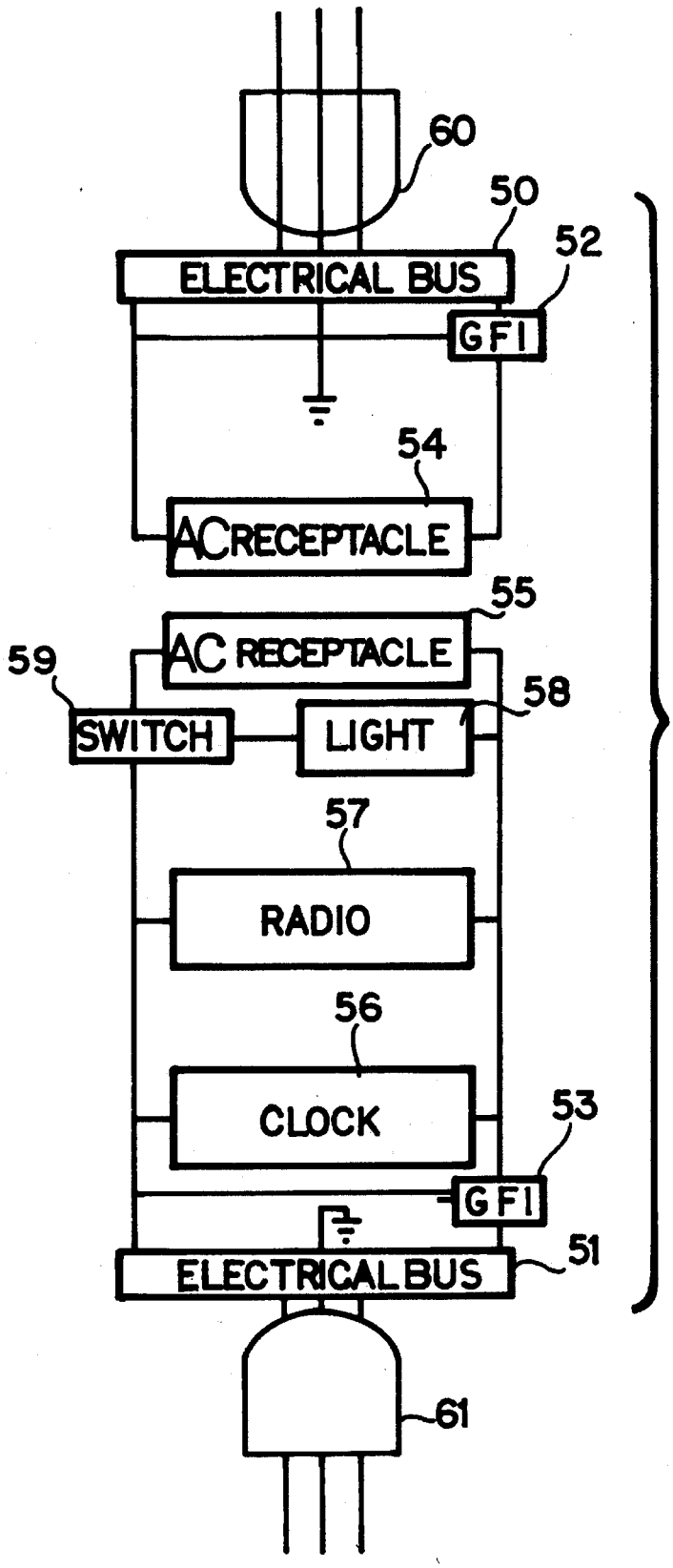
FIG. 6 is an electrical block diagram showing schematically the various components and connections within a fourth preferred embodiment of the combination radio, clock, light, electrical receptacle appliance.

Referring to FIG. 6, the various components and connections within a fourth preferred embodiment of the combination radio, clock, light, electrical receptacle appliance are depicted schematically by an electrical block diagram. Electrical connector 60 is operatively connected to electrical bus 50. Operatively connected to electrical bus 50 are ground fault interrupter 52 and receptacle 54. Likewise, electrical connector 61 is operatively connected to electrical bus 51. Operatively connected to electrical bus 51 are ground fault interrupter 53, light 58 with switch 59, receptacle 55, clock 56 and radio 57.

While there is shown and described the present preferred embodiment of the invention, it is to be distinctly understood that this invention is not limited thereto but may be variously embodied to practice within the scope of the following claims.

I claim:

1. A combination appliance comprising:

a single casing for receiving and holding an electrical buss, electrical receptacle, radio, clock and light;

an electrical buss disposed and held within said casing;

an electrical connector projecting from the casing operatively connected to the electrical buss, the electrical connector being adapted to engage an electrical power supply receptacle;

a radio disposed and held within said casing and operatively connected to the electrical buss;

a clock disposed and held within said casing and operatively connected to the electrical buss;

a light disposed and held within said casing and operatively connected to the electrical buss; and an electrical receptacle disposed and held within said casing and operatively connected to the electrical buss.

2. The combination appliance of claim 1 wherein the electrical connector is adapted to engage an electrical power supply receptacle powered by 110–120 V, 60 Hz power source.

3. The combination appliance of claim 1 wherein the radio operatively connected to the electrical buss further comprises a solid-state radio.

4. The combination appliance of claim 1 wherein the clock operatively connected to the electrical buss further comprises a digital clock.

5. The combination appliance of claim 1 wherein the clock operatively connected to the electrical buss further comprises an analog clock.

6. The combination appliance of claim 1 wherein the light operatively connected to the electrical buss further comprises a low-watt light.

7. The combination appliance of claim 1 wherein the light is operatively connected to the electrical buss through a switching means.

8. The combination appliance of claim 1 which is further modified to provide a plurality of electrical receptacles operatively connected to the electrical buss.

9. The combination appliance of claim 1 which is further modified to provide a ground fault interrupter circuit.

10. The combination appliance of claim 7 wherein the switching means comprises a manually operated switch.

11. The combination appliance of claim 7 wherein the switching means comprises a photocell switch.

12. The combination appliance of claim 7 wherein the switching means comprises a motion sensor switch.

13. A combination appliance comprising:

a single casing for receiving and holding an electrical buss, electrical receptacle, radio, clock and light;

an electrical buss disposed and held within said casing;

an electrical connector projecting from the casing operatively connected to the electrical buss, the electrical connector being adapted to engage an electrical power supply receptacle;

a solid-state radio disposed and held within said casing and operatively connected to the electrical buss;

a digital clock disposed and held within said casing and operatively connected to the electrical buss;

a low-watt light disposed and held within said casing and operatively connected to the electrical buss;

a ground fault interrupter circuit connected to the electrical buss; and an electrical receptacle disposed and held within said casing and operatively connected to the electrical buss.

14. The combination appliance of claim 13 wherein the light is operatively connected to the electrical buss through a switching means.

15. The combination appliance of claim 14 wherein the switching means comprises a manually operated switch.

16. The combination appliance of claim 14 wherein the switching means comprises a photocell switch.

17. The combination appliance of claim 14 wherein the switching means comprises a motion sensor switch.

18. The combination appliance of claim 14 which is further modified to provide a plurality of electrical receptacles operatively connected to the electrical buss.

19. A combination appliance comprising:

a single casing for receiving and holding two electrical busses, two electrical receptacles, a radio, a clock and a light;

two electrical busses, a first electrical buss and a second electrical buss disposed and held within said casing;

two electrical connectors, a first electrical connector and a second electrical connector, projecting from the casing, each electrical connector operatively connected to an electrical buss, the electrical connectors being adapted to engage an electrical power supply receptacle;

a radio disposed and held within said casing operatively connected to either the first electrical buss or the second electrical buss;

a clock disposed and held within said casing operatively connected to either the first electrical buss or the second electrical buss;

a light disposed and held within said casing operatively connected to either the first electrical buss or the second electrical buss; and two electrical receptacles, a first electrical receptacle and a second electrical receptacle, each electrical receptacle disposed and held within said casing operatively connected to an electrical buss.

* * * * *